United States Patent [19]

Lowes

[11] Patent Number: 4,918,931

[45] Date of Patent: Apr. 24, 1990

[54] COMPRESSOR SLUGGING PREVENTION METHOD FOR A REFRIGERATION SYSTEM

[75] Inventor: Albert R. Lowes, Roseville, Calif.

[73] Assignee: Mydax Corporation, Auburn, Calif.

[21] Appl. No.: 402,501

[22] Filed: Sep. 5, 1989

[51] Int. Cl.[5] ..... F25B 43/04

[52] U.S. Cl. ..... 62/83; 62/197; 62/509

[58] Field of Search ..... 62/83, 509, 114, 117, 62/197

[56] References Cited

U.S. PATENT DOCUMENTS

| | | | |
|---|---|---|---|
| 3,741,688 | 6/1973 | Krosby | 417/372 |
| 4,178,465 | 12/1979 | Slayton | 62/83 |
| 4,275,570 | 6/1981 | Szymaszek et al. | 62/468 |
| 4,309,980 | 1/1982 | McCormack et al. | 62/119 X |
| 4,419,865 | 12/1983 | Szymaszek et al. | 62/193 |

*Primary Examiner*—William E. Tapolcai

*Attorney, Agent, or Firm*—David B. Harrison

[57] ABSTRACT

A method and apparatus for preventing compressor slugging in a vapor-compression system having an outlet and an inlet connected by a closed loop injects an immiscible charging gas such as nitrogen into the system in an amount sufficient to raise the system pressure by a predetermined amount. The charging gas is separated from the refrigerant and collected in a charging gas separation area of a receiver in the loop. The charging gas remains in the charging gas separation area of the receiver until the power to the compressor system is shut off. A valve in a branch line leading from the charging gas separation area of the receiver automatically opens when the power is lost which releases the charging gas to pressurize the compressor. Pressurization prevents refrigerant in the system from migrating into the compressor to cause slugging when the compressor is reactivated. The anti-slugging method and apparatus can be utilized in any liquid compression system and is particularly adapted for use in air-cooling compression systems such as air conditioners and refrigerators.

23 Claims, 1 Drawing Sheet

COMPRESSOR SLUGGING PREVENTION METHOD FOR A REFRIGERATION SYSTEM

FIELD OF THE INVENTION

The present invention relates to a method and apparatus for pressurizing a compressor with a gas to prevent excess refrigerant in liquid phase from being within the compressor cylinder when the compressor is turned off. The invention finds special application in closed-loop vapor-compression air cooling systems, such as air conditioners and refrigerators.

BACKGROUND OF THE INVENTION

Refrigeration/heatpump systems commonly employ a compressor with an outlet and a suction inlet connection by at least one closed loop wherein a fixed amount of refrigerant is successively circulated, condensed and evaporated. Expansion devices are routinely positioned in a main circulation loop between the condenser and the evaporator in order to create, in conjunction with the suction from the compressor inlet, a pressure dropped condition at the evaporator and the main line leading to the suction inlet.

When the refrigeration system is shut off, this pressure dropped condition causes liquid and vapor-phase refrigerant in the system to migrate from the high pressure areas in the system into the compressor until the pressure is equalized throughout the system. The liquid and the vapor-phase refrigerant collects in the oil within the cylinders of the compressor whereupon, in the absence of compressor heating (typically provided by an internal electric heating element) the vapor condenses to form additional liquid.

Liquid refrigerant has a particular propensity for oil, most of which remains within in the compressor. The architecture of the particular refrigeration system may also facilitate migration of refrigerant into the compression chamber of the compressor.

Many air conditioning systems place the compressor outside of the area to be cooled. When the system is shut down, in the evening for example, liquid-phase refrigerant will migrate from the warmer area inside to the colder area outside. Additionally, migration of fluid into the compressor is caused by the lower vapor pressure in the evaporator compared to the vapor pressure in the compressor cylinder which contains oil. Liquid-phase refrigerant can also surge back into a compressor during defrosting of refrigeration systems, or when fans or filter systems fail.

The amount of refrigerant migration into the compression cylinders of the compressor depends upon a number of factors, such as amount of refrigerant, temperature, amount of oil, and length of time that the system is shut off. When power is restored to the system, the non-compressible liquid-phase refrigerant that has migrated to the compressor cylinder cannot escape through the compressor outlet during a compression cycle, typically resulting in catastrophic failure (slugging) of the compressor, as by bending of the crankshaft, for example.

As the temperature of the operating compressor increases, the liquid refrigerant boils off, carrying the oil in the compressor with it, and if the compressor continues to run, it may do so without sufficient lubrication. As the piston moves through its range within the cylinder, a point is reached at which the piston cannot move any more against the incompressible liquid refrigerant-/lubricating oil mixture. At this point "slugging" leading to immediate catastrophic failure of the compressor ensues. As mentioned, the crankshaft may bend or break, or the connecting rod may bend or break. Whatever the failure mode, compressor slugging usually results in replacement of the compressor unit, particularly if it is of the ubiquitous hermetically sealed variety.

Several devices have been employed in the prior art in order to prevent compressor slugging. Solenoid valves have been placed in the output and suction input lines of compressors. The valves are closed to prevent freon refrigerant from entering the compressor when the system is shut off. The most common device used to prevent slugging is a compressor crankcase electrical heating element. Various types of crankcase heaters exist and all require electrical power for operation. The heaters may operate continuously when the compressor is turned off in which case the heater maintains the oil in the compressor at a temperature sufficient to maintain the refrigerant in vapor/gas phase and thereby continuously repel the liquid-phase refrigerant from the compressor. Other crankcase heaters are only used when the compressor system is to be reactivated. Extended time periods of pre-heating may typically be required in order to drive the liquid out of the compressor before the compressor system can be reactivated in a refrigeration cycle, depending upon the ambient environmental temperature conditions.

Another type of crankcase heater operates by maintaining a partial supply of alternating current to the compressor via a suitably sized capacitor. This trickle current flow is dissipated as heat within the non-rotating motor and thereby keeps the compressor warmed. All crankcase heaters require electrical power; therefore all of the heaters fail to protect the compressor when power is suddenly restored following a power failute of a sufficiently extended duration to permit liquid-phase refrigerant to enter the compression chamber of the compressor.

As can be seen from the above summary of the prior art, an unsolved need exists for an inexpensive method that is not dependnet upon an uninterruptable electrical power source for reliable prevention of slugging within a compressor.

SUMMARY OF THE INVENTION WITH OBJECTS

A general object of the invention is to provide a method and apparatus to prevent compressor slugging which overcomes the limitations and drawbacks of the prior art.

A more specific object of the invention is to provide a low cost method and apparatus to prevent slugging and a compressor that can be easily adapted to liquid compressor systems.

Another more specific object of the invention is to provide a method and apparatus that is not dependent upon a power source to prevent slugging in a compressor.

One more specific object of the invention is to provide a method and apparatus to prevent slugging in a vapor-compression air cooling compression system.

In accordance with the present invention, an immiscible gas, such as nitrogen or carbon dioxide, is injected into a compressor system having an outlet and an inlet connected by a loop. The gas is chosen so that it does not liquify at any operating temperature, and it does not react or mix with either the refrigerant or with the compressor lubricant. The gas is typically injected as a one time charge in an amount determined by the system pressure. System pressure is measured by conventional means and the gas charge is calculated to raise the system pressure by at least 2 psi.

Operation of the compressor system causes the immiscible, injected gas to collect above the liquid-phase refrigerant in the system in a receiver. When the compressor is operating, the collected gas remains at the top of the receiver and the liquid from the bottom of the receiver continued its passage through the loop to be returned to the compressor inlet in a gaseous state.

When the compressor is shut off, a valve is opened in a branch of the main line to allow passage of the gas from the top of the receiver into the refrigeration main loop. The branch terminates in the main loop allowing the gas to pressurize the compressor chamber and thereby to prevent the refrigerant in the system from migrating into the compressor cylinder and condensing to liquid. The valve preferably is of the type which automatically opens when the electrical power to the system is cut off, i.e. it fails safe in the event of power failure.

In a preferred embodiment, the compressor is part of a vapor-compression air cooling system having a condenser downstream from the compressor, a receiver tank, and an evaporator upstream from the compressor. The receiver tank is used to collect the injected gas. A branch leading from the receiver tank connects to the main loop upstream from the compressor. In another embodiment, the branch leading from the receiver tank connects to the main loop upstream from the evaporator.

These and other objects, features, aspects and advantages of the present invention will be more fully apparent to those skilled in the art upon consideration of the following detailed description of the preferred embodiments, presented in conjunction with the accompanying drawings.

DESCRIPTION OF THE PREFERRED EMBODIMENTS

Figure 1:
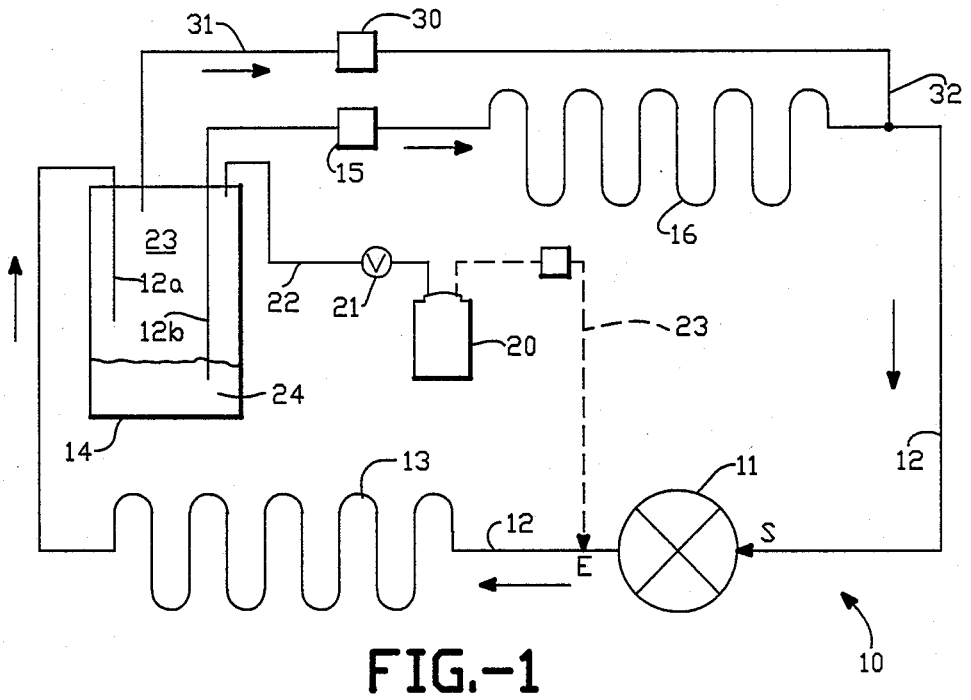
FIG. 1 is a schematic diagram of a compressor system incorporating the principles of the present invention.

FIG. 1 shows a first air-cooling system according to the invention, generally represented by the reference number 10. The system is a vapor-compression system utilizing a standard liquid-gas coolant such as Freon. Principal components of the system are a compressor unit 11, a main coolant loop 12 leading from an exhaust E to a suction inlet S of the compressor unit 11. A water or air cooled condenser 13, a receiver tank 14, an expansion device 15 (such as a throttling valve) leading to an evaporator coil 16 are also included in the main loop 12 which leads back to the suction inlet S of the compressor 11. Arrows are provided for depicting the direction of flow in the main loop.

The evaporator coil 16 could be in an air conditioning duct and additional bypass flow loops could be used. The system 10 may also include several components which are conventional and/or optional in prior art compressor systems and need not be described here. For example, a filter drier, an accumulator in the suction line, a liquid line valve, a heat exchanger and thermostat devices may be included within the system 10.

Referring to FIG. 1, a one time charge of a suitable compressed, immiscible charging gas, such as nitrogen or carbon dioxide, is contained in gas cylinder 20. Valve 21 is opened to allow the gas to pass from cylinder 20 through the line 22 and into the receiver 14. The charging gas may be injected anywhere in the system; and, an alternative injection point in the main loop and downstream from the compressor 11, shown as an example only, is indicated by dashed line 23. The amount of gas to be injected is not critical, but should be sufficient to raise the system main loop pressure at the receiver 14 by a minimum of about 2 psi and, in general, not more than 20 psi. The pressure of the system 10 may be determined using any conventional method, such as system temperature conversion techniques.

When the compressor 11 of system 10 is operating, all of the injected charging gas from cylinder 20 will eventually pass into receiver 14 through the main loop 12 at **12*a*. Receiver 14 is of sufficient size to permit the charging gas to separate from the refrigerant in the receiver 14. The immiscible charging gas is collected in a top charging gas separation area 23 of the receiver 14 and the condensed refrigerant liquid collects in the bottom portion 24 of the receiver 14**.

As the compressor 11 of system 10 continues to operate, the liquid refrigerant passes from the bottom portion 24 of the receiver 14 back into the main loop at point **12*b* and out of receiver 14. The refrigerant then proceeds through an expansion device 15, such as an expansion valve, through the evaporator 16 and into the compressor 11**.

When power to the compressor system 10 is shut off, the valve 30 opens and permits the collected gas from the top separation area 23 of the receiver 14 to flow into the branch line 31. The collected gas continues to flow through branch line 31 and into the main loop 12 at a point 32. The immiscible charging gas continues its passage until it reaches the compressor 11. The valve 30 is preferably of the type that automatically opens when the electrical power to the system is shut off, such as a normally open solenoid valve. Passage of the immiscible charging gas into the low pressure side of the system, the evaporator 16 and the compressor 11 side, pressurizes the compressor 11 and equalizes the pressure throughout the system 10 when it is not in service. The pressurization prevents migration of the majority of the liquid or vaporized refrigerant through the expansion device 15 into the low pressure side of the system 10, such migration being a naturally occurring phenomenon in response to unequally, pressuzed communicating flow paths.

Figure 2:
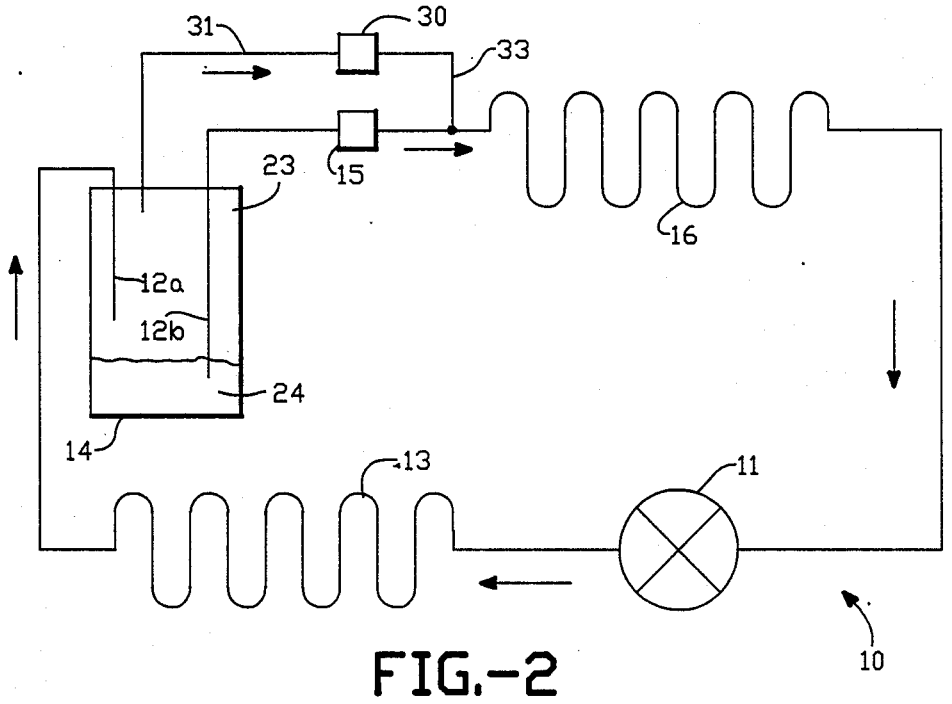
FIG. 2 is a schematic diagram of a compressor system showing another embodiment of the present invention.

In a second preferred embodiment shown in FIG. 2, the immiscible charging gas line 31 joins the main coolant loop 12 at a point 33 thereby passing through the evaporator 16 prior to its passage into the compressor 11. The FIG. 2 system is the same as that shown in FIG. 1 in all other respects; and, the charging gas injection apparatus has been omitted to save drawing space.

As can be seen from the above description of the preferred embodiments, the anti-slugging method and apparatus is not dependent upon electrical power and therefore provides protection for the compressor should a sudden power outage occur. The anti-slugging apparatus and method greatly increase the life of the compressor and can easily be adapted for use in any liquid compression system.

The apparatus and method shown and described herein are illustrative of the principle of the invention and are not meant to be limiting of its scope. Various other embodiments will be apparent to those skilled in the art and may be made without departing from the spirit and scope of the invention as defined by the following claims.

I claim:

1. A method for preventing refrigerant from slugging in an electrical refrigeration compressor system, the method comprising the steps of:

injecting an immiscible charging gas into the compressor system to raise pressure by a predetermined amount;

normally separating the charging gas from the refrigerant in a receiver within the compressor system; and applying the charging gas to the compressor system when primary operation power to the compressor system is turned off, thereby pressurizing a compressor of the system and preventing the refrigerant in the system from entering the compressor in an amount sufficient to cause slugging.

2. The method of claim 1, further comprising the steps of: measuring the pressure of the operating compressor system prior to injecting the charging gas; and injecting the charging gas all at once in an amount sufficient to raise the measured pressure by the predetermined amount which is at least about 2 psi.

3. The method of claim 2, wherein the step of applying the charging gas to pressurize the compressor further comprises the steps of: opening a valve when the compressor system is turned off to release the separated charging gas from a charging gas separation area of the receiver; and conducting the released gas from the receiver through a line exiting from the charging gas separation area of the receiver, the line passing the charging gas through the valve and into the compressor.

4. The method of claim 3, wherein the step of applying the charging gas to pressurize the compressor further comprises the step of: activating a normally open solenoid valve in the conducting line, the solenoid valve opening automatically when the power to the compressor is turned off.

5. The method of claim 4 wherein the compressor system is a vapor-compression air cooling system having a liquid-gas coolant, a condenser, a receiver, and at least one evaporator, further comprising the step of: passing the charging gas from the solenoid valve into the evaporator before passage into the compressor.

6. The method of claim 5 wherein the charging gas is nitrogen.

7. The method of claim 5 wherein the charging gas is carbon dioxide.

8. An electrical refrigeration compressor system for preventing refrigerant front slugging the compressor, comprising:

a compressor having an inlet and an outlet, the inlet and outlet connected by a closed main loop;

an injection means for injecting an immiscible charging gas into the compressor system to raise pressure by a predetermined amount;

a receiver for separating the injected charging gas and the refrigerant flowing in the main loop of the operating compressor system; and a branch in the main loop for conducting the collected charging gas from the receiver into the compressor, the branch having control means for allowing passage of the charging gas into the branch and into the compressor when the compressor system is turned off, the presence of the charging gas in the compressor pressurizing the compressor and preventing slugging of the compressor by the refrigerant in the compressor system.

9. The electrical refrigeration compressor system of claim 8 wherein the injection means further comprises: a valve for a one time injection of the charging gas into the system, the valve releasing the charging gas in an amount sufficient to raise the compressor system pressure by the predetermined amount which is at least about 2 psi.

10. The electrical refrigeration compressor system of claim 9 wherein the receiver defines a charging gas separation area for collection of the separated charging gas and a bottom area for collection of the refrigerant, the branch in the main loop originating in the charging gas separation area.

11. The electrical refrigeration compressor system of claim 10 wherein the control means in the branch is a valve, the valve opening when the power to the compressor system is turned off.

12. The electrical refrigeration compressor system of claim 11 wherein the charging gas is nitrogen.

13. The electrical refrigeration compressor system of claim 11 wherein the charging gas is carbon dioxide.

14. The electrical refrigeration compressor system of claim 12 wherein the compressor is part of a vapor-compression air-cooling system having a liquid-gas coolant, a condenser, a receiver, at least one closed flow loop, and at least one evaporator.

15. In a vapor-compression air cooling system having a compressor, a condenser downstream of the compressor in a main loop, a receiver, an evaporator upstream from the compressor, an apparatus to prevent refrigerant from slugging the compressor, comprising:

an injection means for injecting an immiscible charging gas into the system to raise pressure by a predetermined amount;

a charging gas separation area in the receiver for collecting the charging gas when the system is operating;

a branch line leading from the charging gas separation area in the receiver for conducting the collected charging gas to the condenser when the power to the system is turned off; and a control means in the branch line for controlling passing of the charging gas through the branch line, passage of the charging gas into the compressor pressurizing the compressor and preventing the refrigerant in the system from entering the non-operating compressor in an amount sufficient to cause liquid slugging of the compressor.

16. The vapor-compression air cooling system of claim 15 wherein the injection means comprises a valve for a one time injection of the charging gas into the system, the valve releasing charging gas in an amount sufficient to raise the system pressure by the predetermined amount which is at least 2 psi.

17. The vapor-compression air cooling system of claim 16 wherein the branch line originates in the charging gas separation area of the receiver, the receiver further having a refrigerant outlet originating in a bottom area of the receiver to continue the main loop flow of refrigerant into the evaporator.

18. The vapor-compression air cooling system of claim 17 wherein the control means comprises a valve in the branch line, the valve opening to allow passage of the charging gas when the power to the system is turned off.

19. The vapor-compression air cooling system of claim 18 wherein the branch line originates in the charging gas separation area of the receiver and terminates in the main loop upstream from the compressor.

20. The vapor-compression air cooling system of claim 19 wherein the branch line terminates in the main loop upstream from the evaporator.

21. The vapor-compression air cooling system of claim 19 wherein the charging gas is nitrogen.

22. The vapor-compression air cooling system of claim 19 wherein the charging gas is carbon dioxide.

23. An electrical refrigeration compressor system comprising:

a compressor having an inlet and an outlet, the inlet and outlet connected by a main loop;

a main loop having a condenser downstream of the compressor, the condenser for cooling compressed gas;

an injection valve for injecting an immiscible charging gas into the compressor system in an amount sufficient to raise the system pressure by at least about 2 psi;

a receiver downstream from the condenser for collecting the charging gas and the refrigerant flowing from the condenser, the receiver collecting the charging gas in a charging gas separation area of the receiver and collecting the refrigerant in a bottom space of the receiver;

an expansion means downstream from the receiver for expansion of the refrigerant in the main loop flowing from the bottom of the receiver;

an evaporator downstream from the expansion device and upstream from the compressor; and a branch in the main loop for conducting the charging gas from the charging gas separation area of the receiver and into the compressor, the branch having a means for controlling the flow of the charging gas from the receiver, the branch allowing pressurization of the compressor with the charging gas when the compressor system is turned off.

* * * * *